US009352861B2

(12) United States Patent
Murai et al.

(10) Patent No.: US 9,352,861 B2
(45) Date of Patent: May 31, 2016

(54) VORTEX REDUCTION CAP

(71) Applicant: Mega Fluid Systems, Inc., Tualatin, OR (US)

(72) Inventors: Koh I. Murai, Yamhill, OR (US); David D. Kandiyeli, Mesa, AZ (US)

(73) Assignee: MEGA FLUID SYSTEMS, INC., Tualatin, OR (US)

( * ) Notice: Subject to any disclaimer, the term of this patent is extended or adjusted under 35 U.S.C. 154(b) by 356 days.

(21) Appl. No.: 13/718,430

(22) Filed: Dec. 18, 2012

(65) Prior Publication Data

US 2013/0160878 A1 Jun. 27, 2013

Related U.S. Application Data

(60) Provisional application No. 61/579,379, filed on Dec. 22, 2011.

(51) Int. Cl.

| | |
|---|---|
| ***F02M 37/22*** | (2006.01) |
| ***B65B 3/04*** | (2006.01) |
| ***B01F 5/00*** | (2006.01) |
| ***B01F 5/02*** | (2006.01) |
| ***B01F 5/10*** | (2006.01) |
| ***B01F 3/08*** | (2006.01) |

(Continued)

(52) U.S. Cl.

CPC ..... *B65B 3/04* (2013.01); *B01F 3/0857* (2013.01); *B01F 3/0861* (2013.01); *B01F 5/0057* (2013.01); *B01F 5/0218* (2013.01); *B01F 5/10* (2013.01); *B01F 15/005* (2013.01); *B01F 15/0266* (2013.01); *Y10T 137/86348* (2015.04)

(58) Field of Classification Search

CPC ..... B01F 3/0857; B01F 3/0861
USPC ..... 137/544, 547, 549
See application file for complete search history.

(56) References Cited

U.S. PATENT DOCUMENTS

| | | | | |
|---|---|---|---|---|
| 4,394,966 | A | | 7/1983 | Snyder et al. |
| 4,422,771 | A | * | 12/1983 | Earhart et al. ..... 366/251 |
| 4,901,762 | A | | 2/1990 | Miller, Jr. et al. |

(Continued)

FOREIGN PATENT DOCUMENTS

| | | | |
|---|---|---|---|
| JP | 10323293 | A | 12/1998 |
| JP | 2008530406 | A | 8/2008 |

(Continued)

OTHER PUBLICATIONS

International Search Report and Written Opinion for International Application No. PCT/US2012/070846 mailed Apr. 25, 2013.

*Primary Examiner* — Craig Schneider
*Assistant Examiner* — Angelisa L Hicks
(74) *Attorney, Agent, or Firm* — Heslin Rothenberg Farley & Mesiti P.C.

(57) ABSTRACT

A vortex reduction cap for use within a fluid holding vessel above a discharge port for discharging the fluid from the vessel is disclosed. The vortex reduction cap includes a top solid surface greater than or equal to the area of the discharge port. The vortex reduction cap includes one or more inlets to allow fluid to flow from the vessel to an internal volume of the vortex reduction cap and then to the discharge port in the vessel. A passive element is positioned within the internal volume of the vortex reduction cap so that the flow of fluids through the cap and towards the discharge port of the vessel will be redirected around the passive element.

12 Claims, 13 Drawing Sheets

(51) Int. Cl.
*B01F 15/02* (2006.01)
*B01F 15/00* (2006.01)

(56) References Cited

U.S. PATENT DOCUMENTS 5,293,895 A 3/1994 Grove et al.
6,014,987 A 1/2000 List et al.
6,536,468 B1 * 3/2003 Wilmer et al. ..... 137/544
6,591,867 B2 * 7/2003 Grayson ..... 137/590
2005/0024829 A1 2/2005 Horng et al.
2008/0245421 A1 * 10/2008 Iou ..... 137/377
2009/0162198 A1 6/2009 Ogino et al.

FOREIGN PATENT DOCUMENTS

JP 2008221240 A 9/2008
JP 2008265782 A 11/2008
KR 0948283 B1 3/2010

* cited by examiner

VORTEX REDUCTION CAP

CROSS REFERENCE TO RELATED APPLICATION

This application claims priority benefit under 35 U.S.C. §119(e) of U.S. provisional patent application No. 61/579,379 filed Dec. 22, 2011, which is incorporated herein by reference in its entirety.

TECHNICAL FIELD OF THE INVENTION

The present invention relates, in general, to tanks for mixing and holding process fluids and, more particularly, to an apparatus that redirects fluid flow as it passes out of the discharge port of the tank for reducing or eliminating vortex formation and resulting air entrapment.

BACKGROUND OF THE INVENTION

Many industrial processes require exact mixing and control of the delivery of various process fluids. For example, in the pharmaceutical and semiconductor industries, process fluids must be precisely mixed and the delivery of the mixed process fluid to a process tool must be precisely controlled. As used herein, a fluid can be any type of matter in any state that is capable of flow such as liquids, gases, powders, and slurries, and comprising any combination of matter or substance to which controlled flow may be of interest. Commonly, two or more components must be mixed, typically in a mixture/holding tank, to form a desired solution mixture for a particular process.

Various means for mixing such fluids are known in the art. Both intrusive and non-intrusive means have been used to mix fluids, including colloidal suspensions, to prevent separation of homogeneous solutions into constituent components and/or to reconstitute solutions that have separated into constituent elements. Intrusive mixing devices, or those objects and devices which are inserted into a fluid to agitate the fluid with the assistance of an external power source, are well known.

In the semiconductor industry, for example, it is common to mix certain process chemicals, such as slurries used for chemical mechanical polishing ("CMP"). CMP is a semiconductor processing technology in which a wafer surface is smoothed using a combination of mechanical and chemical forces, and has long been an essential process in the production of semiconductor chips.

Typically the chemicals required for such CMP processes are prepared in a batch process where a relatively large supply is prepared in mixing/holding tanks and stored for later use. Tanks holding, for example, 500 liters and 265 liters are commonly used, usually having conical-shaped bottom with a discharge port at the apex of the cone to promote complete draining. More recently, it has become increasingly common for users of these types of mixed process chemicals, to prepare a very small first batch, for example, a batch of only 25 to 50 liters. This allows a user to mitigate any impact from any variation in the process chemicals until the mixing process has stabilized. Further, bringing multiple process lines online at the same time is often beyond the capabilities of the pumping system so process lines are brought online one at a time. After the small initial batch, as the process ramps up and/or the process chemical mix stabilizes, the subsequent batches will usually gradually increase in size.

FIG. 1 shows a prior art mixing tank 10 having a multiple jet mixer 22 that is used to mix process chemicals together. Once the process materials have been adequately mixed, the process material is typically transferred from the mixing/holding tank 10 through a discharge port 14 on the base 54 of the tank via a pump 30 to a global loop 40 to the final points of use for its intended application. Points of use may be any location where there is demand for a supply of the blended process material. For example, points of use may include process machinery or tools 32 in a semiconducting fabrication facility.

As the process fluids are drawn from the tank through the discharge port, a vortex typically forms in the fluid above and along the centerline of the discharge port. A vortex is a smooth, roughly conical, rotating liquid void that forms in a fluid body as a result of a low pressure area. If the fluid level in the tank is low enough, the vortex will reach the surface and draw air (or whatever gas is in the tank) down through the fluid and out through the discharge port. Air in the process fluid delivery system is highly undesirable for a number of reasons. For example, the presence of air in the system can result in oxidation of certain chemical mixtures thereby changing the chemical reactivity and composition of the fluid, it can cause agglomeration of the slurries, and it can cause difficulties in maintaining proper fluid pressure and flow. Entrapped air can also cause the pump, used to draw out the process fluid, to lose prime and stop moving the fluid; this can reduce the effective surface area if it collects inside a filter housing. Fluids, and in particular, colloidal suspensions such as slurries used in CMP of semiconductor wafers, are most effective when delivered to CMP tools in a homogenous state, with no air in the supply line delivering fluid to these tools.

A number of methods are known in the prior art for reducing air entrapment resulting from vortex formation. One such method is described in U.S. Pat. No. 6,536,468 to Wilmer et al., for "Whirlpool Reduction Cap" (Mar. 25, 2003) ("Wilmer I"), which is assigned to the assignee of the present invention and incorporated herein by reference. Wilmer describes a cap with openings in the sidewalls that can be used to cover the discharge port and discourage vortex formation. For very low fluid levels, however, the Wilmer cap still allows the production of a vortex that can lead to air entrapment. Other types of vortex suppression devices are also known.

Accordingly, what is needed is an improved method and apparatus for preventing the formation of a vortex and resulting air entrapment in a processing fluid tank at low fluid levels.

SUMMARY OF THE INVENTION

Embodiments of the present invention solve the aforementioned problems by providing passive elements within the flow path through a discharge cap placed over the discharge port at the bottom of a process fluid mixing/holding tank. In preferred embodiments, the passive elements comprise one or more turbine blades that spin as the fluid flows past the blades. A variety of static posts or pins could also be used to break up the flow through the discharge cap and prevent vortex formation at low fluid levels.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION OF PREFERRED EMBODIMENTS

Preferred embodiments of the present invention are directed at a discharge cap that provides passive elements within the flow path through the cap so that fluid flow out through the discharge port at the bottom of a process fluid mixing/holding tank is disrupted and redirected to prevent surface vortex formation and resulting air/gas entrainment. Preferably, the passive elements comprise one or more turbine blades that spin as the fluid flows past the blades. Suction produced by a pump, venturi, gravity, or other methods provides the motive force to spin the passive blades. A variety of static posts or pins could also be used to break up the flow through the discharge cap and prevent vortex formation at low fluid levels.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable.

Figure 1:
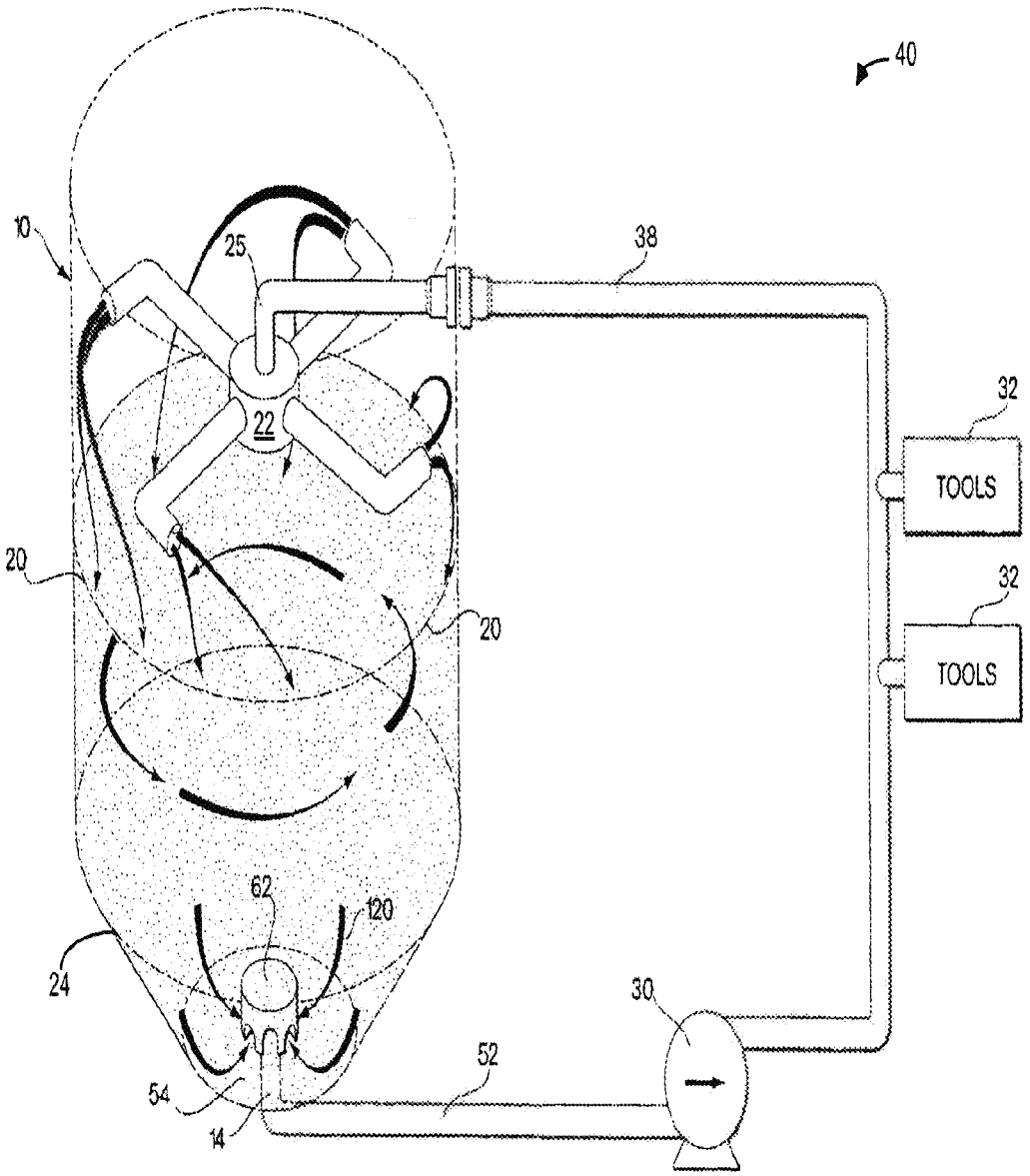
FIG. 1 shows a prior art mixing tank.

FIG. 1 shows a prior art mixing tank containing intrusive and non-intrusive mixers. Such a mixing tank is described in U.S. Pat. No. 6,109,778 to Wilmer for "Apparatus for homogeneous mixing of a solution with tangential jet outlets" (Aug. 29, 2000), and incorporated herein by reference. In FIG. 1, the mixing tank also includes a whirlpool reduction cap 62 as described in Wilmer I. Whirlpool reduction cap 62 is positioned in a tank 10 above a discharge port or drain 14 and assists in controlling the direction of fluid velocity at the discharge port 14. Tank 10 as depicted in FIG. 1 may be, for example, a cylindrical vessel. However, the shape of the mixing tank is not critical in the present invention, and other shaped holding vessels may also be employed. Additionally, although the base of mixing tank 10 is depicted in FIG. 1 in a conical form, the form of the base is not critical, and other forms, including, but not limited to, hemispherical and truncated forms, may also be used.

As illustrated in FIG. 1, fluid may be introduced to the tank, for example, through delivery line 25 where it passes into multiple jet mixer 22. It is also contemplated that fluid may be introduced to the tank from any position on the tank, including but not limited to the top, sides, or bottom. An outlet connection at base 54 of mixing tank 10 leads to supply line 52 and to a circulating pump 30, through which fluid is either circulated to tools 32 that will use the fluid, for example in CMP applications where the fluid is a colloidal suspension such as slurry, or recirculated back into mixing tank 10 through delivery line 25 and back through the multiple jet mixing assembly 22 where the mixing process begins anew.

Figure 2:
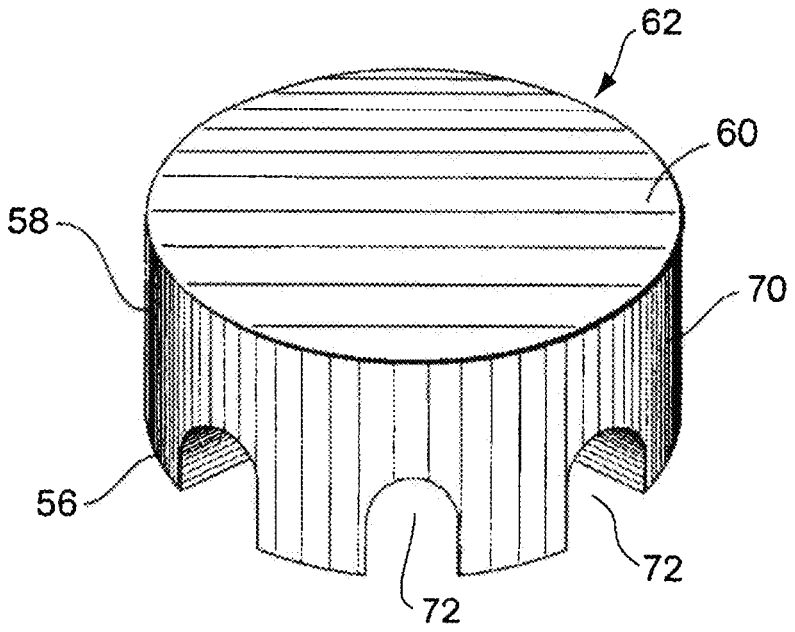
FIG. 2 shows a top front perspective view of a prior-art whirlpool reduction cap.

FIG. 2 shows a top front perspective view of a prior-art whirlpool reduction cap 62. As shown in FIG. 2, whirlpool reduction cap 62 may comprise a formed body 70 which may be ideally made of, for example, a material that is homogeneous with other components of the mixing apparatus, although other materials are also contemplated. The whirlpool reduction cap 62 may be affixed at base 54 of mixing tank 10 by conventional means such as, for example, welding, clamping, screwing, and chemical bonding. Fluid flows through the whirlpool reduction cap 62 by way of multiple inlet orifices 72, which extend through the sidewalls 58 of the cap 62 to channel fluid through body 70 and into discharge port 14 at base 54 of mixing tank 10.

The placement of whirlpool reduction cap 62 is illustrated in FIG. 1. Whirlpool reduction cap 62 is affixed at base 54 of the mixing tank 10 above the discharge port 14, and serves to decrease vortex formation in the fluid body. As fluid or slurry is demanded by a process tool 32 fluid level 20 will decrease. As fluid is continually cycled, the fluid is orientated in a downward direction and velocity toward discharge port 14. This creates what is known as a "Coriolis Effect" in the moving fluid body which is seen as a vortex or whirlpool about a centerline of the drain. A vortex forming in lower fluid levels tends to draw air into supply line 38 as the result of suction created by pump 30. Any air drawn into outlet line 52 will decrease the overall performance of the fluid delivery system and interfere with inline instrumentation monitoring the performance of the system. If, however, the direction of the fluid velocity at the drain point is altered, for example by channeling the fluid through the side ports of the whirlpool cap 62 along path 120, the "Coriolis Effect" is changed. The overall velocity direction as the fluid flows into the orifices 72 being perpendicular to the above orientation of the fluid velocity creates multiple subsurface vortices, which tend to cancel each other out.

Applicants have discovered, however, that prior art vortex suppression devices such as the Wilmer whirlpool reduction cap are much less effective at lower fluid levels. This is especially problematic for processes such as CMP processes where it is desirable to start the process with a small batch of mixed process fluid and then gradually increase the size of subsequent batches as the process ramps up to capacity. It is common for these initial small batches to have a turndown ratio of greater than 10:1 when the batch size is compared to the tank capacity. For example, the first batch mixed in a 500-liter tank might be only 25-50 liters. Referring again to FIG. 1, the initial batch size might only reach fluid level 24 or even less.

At these fluid levels for a typical conical bottom tank, there is barely enough fluid to prime the pump and start the discharge process. The prior-art Wilmer whirlpool reduction cap 62 will thus be very close to the fluid surface under those conditions. Fluidic studies have shown that the submergence depth is a key factor in avoiding a surface vortex. The minimum necessary submergence depth varies directly with fluid velocity passing through the discharge port. Because the side openings in the prior-art Wilmer whirlpool reduction cap will be very close to the fluid surface under the conditions described above, vortex formation and resulting air or gas entrainment or entrapment is a significant problem. The internal cylinder of the Wilmer whirlpool cap 62 is essentially empty, in other words, there are no internal elements or features that will disrupt or break up the fluid flow path.

Figure 3:
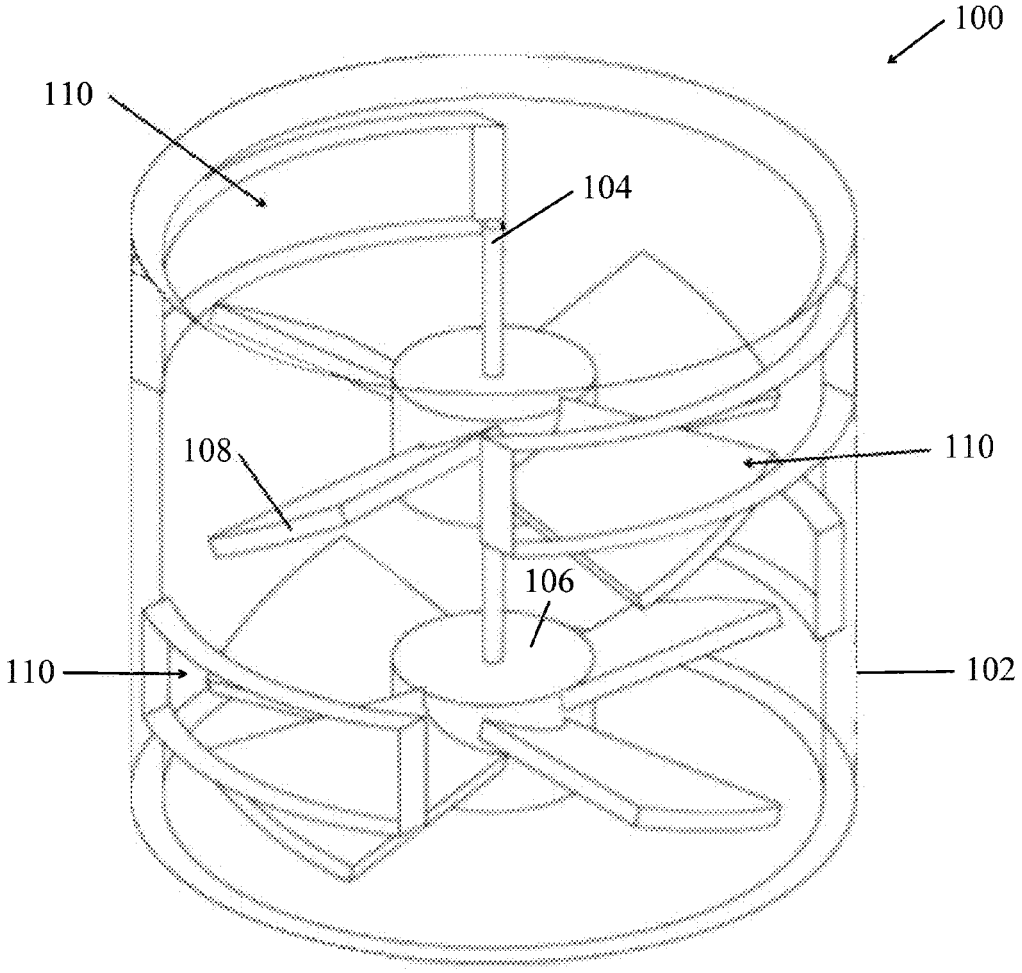
FIG. 3 shows a side perspective view of a vortex reduction cap, in accordance with an aspect of the present invention.
Figure 4:
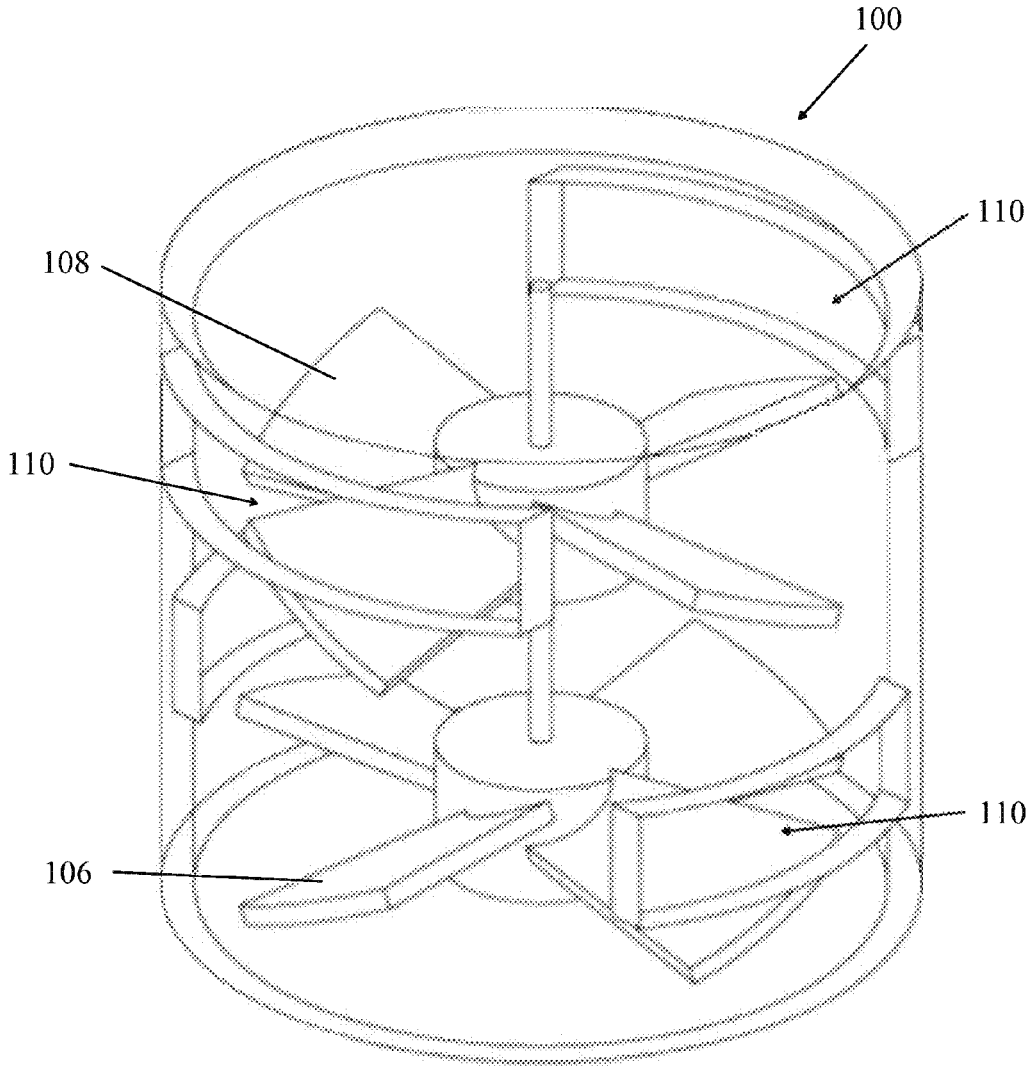
FIG. 4 shows a top perspective view of a vortex reduction cap, in accordance with an aspect of the present invention.

FIGS. 3 and 4 show a vortex reduction cap 100 according to a preferred embodiment of the present invention. The vortex reduction cap 100 of FIG. 3 comprises a formed body 102 that may be made of any suitable known material such as, for example, polymers, steel, metal, and the like. The vortex reduction cap 100 may be preferably formed, for example, from a material that is homogeneous with other components of the mixing apparatus, although other materials are also contemplated. The vortex reduction cap 100 preferably has a top solid surface with an area that is greater than or equal to the open area of the discharge port. In other words, it is preferable that the cap 100 cover the entire discharge port. As used herein, the term "solid" is defined as having little or no opening in order to redirect a majority of fluid flow away from the centerline of the discharge port. The top solid surface may be of any shape such as, for example, square, hemispherical, or pyramidal. In the embodiment of FIGS. 3-4, the vortex reduction cap 100 may for example, have a diameter of approximately 4" and a height of approximately 3". Skilled persons will recognize that the cap size will depend on the size of the tank and of the discharge port.

The vortex reduction cap 100 may comprise one or more sidewalls of any shape including, for example, irregular or perpendicular to the top surface and/or the vessel base. The sidewall is positioned between the top solid surface and the cap base and may extend to any height above the vessel base and may preferably be perpendicular to the horizontal plane of the discharge port. Preferably, the sidewall has sufficient height so that the vortex reduction cap 100 can accommodate a plurality of inlets 110 for fluid to flow through the vortex reduction cap 100 and one or more desired passive elements in the flow path, such as turbine-style blades, other forms of impellers and the like (described below). Preferably, the combination of the inlets 110 and passive elements allow fluid to flow through the discharge port without a significant reduction in fluid volume throughput. As used herein, the phrase "significant reduction" means the volume of flow through the discharge port is not restricted by, for example, more than about 5%.

Figure 5:
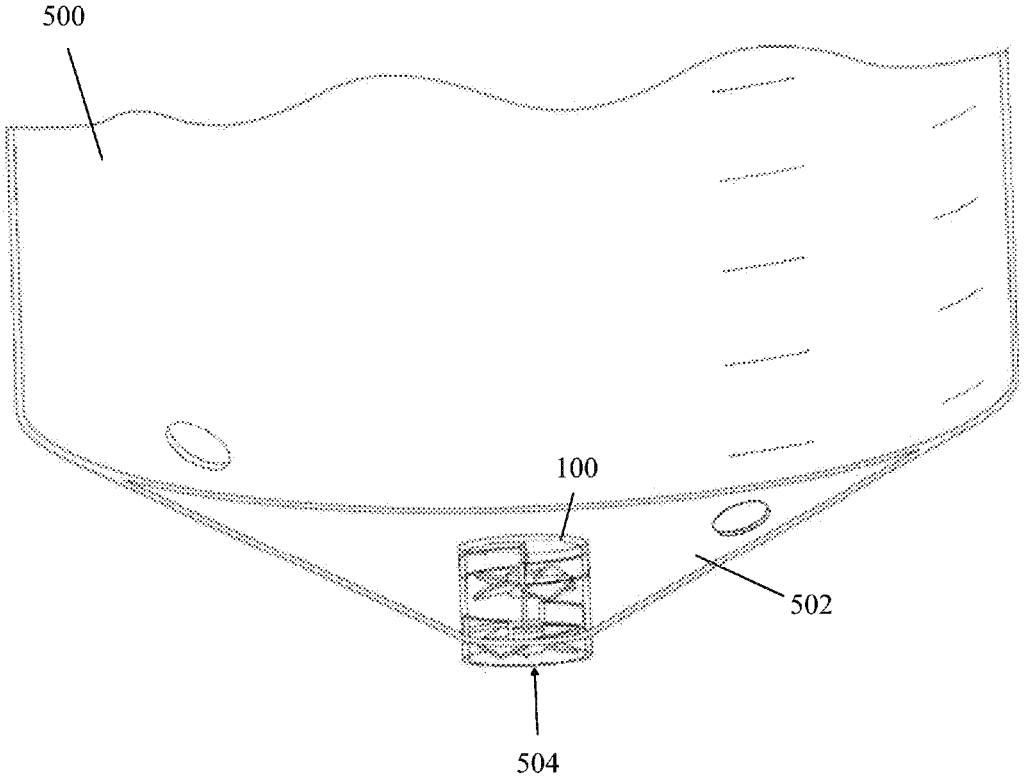
FIG. 5 shows the vortex reduction cap of FIG. 3 installed in a mixing tank over the discharge outlet, in accordance with an aspect of the present invention.

Inlets 110 consist of openings through the sidewall of the vortex reduction cap body 102 so that fluid can flow in through the inlets 110 to the interior volume of the vortex reduction cap 100 and out to the discharge port through the base of the cap 100. The inlets 110 may be any desired shape, for example the inlets may be rectangular, as shown in the embodiments of FIGS. 3-5. In the preferred embodiment of FIG. 3, the vortex reduction cap 100 is a hollow cylinder, closed or capped at the top, but with an opening at the bottom (the end of the vortex reduction cap 100 oriented toward the discharge port). Preferably there are a plurality of inlets 110 through the vortex reduction cap body 102. The vertical plane of the one or more inlets 110 is preferably positioned perpendicular to a horizontal plane of the discharge port. The one or more inlets 110 are preferably positioned and arranged to provide balanced flow about the perimeter of the whirlpool reduction cap 100.

In the embodiment shown in FIGS. 3 and 4, a plurality of inlets 110 are arranged so that the inlets 110 are staggered, which can serve to break up the flow path through the cap 100. By decreasing the cross-sectional area of each of the inlets 110, local turbulence is increased. The decrease in the area of each individual port is mitigated by adding additional inlet ports so that the bulk restriction is decreased. Staggering the inlet ports increases the directional heterogeneity of the bulk fluid as it enters the anti-vortex device.

FIG. 5 shows the vortex reduction cap 100 installed in a mixing tank 500 at the bottom of conical bottom 502 and over the discharge outlet 504. The cap base connects to the discharge port 504 of the tank by any known conventional means. For example, the cap base may comprise a flange for securing the cap 100 to the tank base by a variety of means including, for example, screws, adhesives and welding. The vortex reduction cap 100 may further comprise a chute extending from the base for insertion into the discharge port. The chute may be constructed and arranged to press fit into a non-threaded discharge port or may comprise a threaded outer surface to mate with a reverse threaded surface in the discharge port. Alternatively, the sidewall may extend into the discharge port.

One or more passive elements are preferably positioned within the inner volume of the vortex reduction cap 100, downstream from the inlets 110, to break up or redirect the fluid flow through the cap 100. Vortex formation where there is a relatively smooth fluid flow, whereas agitation and turbulent flows discourage the formation of stable vortices. In the embodiment of FIG. 3, the passive elements comprise at least two turbine blades 106, 108 that can rotate around a shaft in the center of the cylindrical vortex reduction cap 100. The angle of the blades 106, 108 will cause passive (non-motorized) rotation as the fluid flows past the turbine blades; and the rotation will tend to promote mixing and disrupt the formation of any vortex extending to the discharge port at the base of the tank 500. Because of the position of the inlets 110 in the embodiment of FIGS. 3-5, the liquid will flow orthogonal to the turbine blades 106, 108. Turbine blades 106, 108 preferably rotate on a pin or shaft 104, which is coaxial with the vortex reduction cap cylinder, and which can be attached to the upper inner surface of the solid top of the cap 100 and attached to one or more braces at the bottom (toward the discharge port).

Where, as in FIG. 3, multiple turbine blades 106, 108 are used, it is preferable that the blades be angled so that the each turbine blade 106, 108 spins in the opposite direction as the adjacent blade(s) 106, 108. For example, if the upper turbine blade 108 spins in a counterclockwise direction, it would be preferable for the lower blade 106 to spin in a clockwise direction.

Persons of skill in the art will recognize that the direction and rotational speed of the blades 106, 108 can be controlled by the pitch angle on the blades 106, 108 themselves. Shallower angles will make the blades rotate faster, while larger angles will slow down rotation. The rotation speed will also be impacted by the fluid velocity. If the blades 106, 108 are allowed to spin too rapidly, undesirable cavitation or fluid shear could result. If the blades 106, 108 are allowed to spin too slowly, they will not serve the purpose of disrupting vortex formation and also the blades 106, 108 will then act as an impediment to fluid flow. The optimum pitch angle will vary with fluid height, liquid viscosity, liquid vapor pressure, and pump suction vacuum, and persons of skill in the art will be able to determine an appropriate pitch angle for a given application without undue experimentation. For example, for a typical slurry mixture pumped out of the tank 500 at a typical fluid flow velocity of 0.5 m/s to 1 m/s, the pitch angle of the blades 106, 108 will preferably be from 20 to 50 degrees, more preferably the pitch angle will be approximately 33 degrees, although other angles could be used depending on the variables described above.

Figure 6:
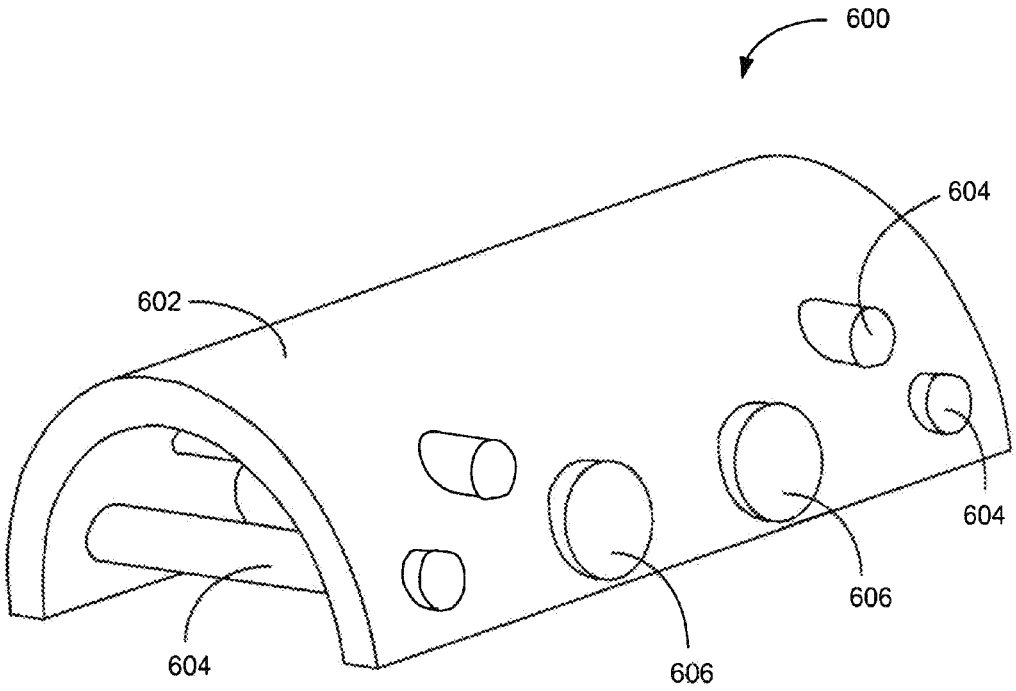
FIG. 6 shows a side perspective view of a vortex reduction cap, in accordance with an aspect of the present invention.
Figure 7:
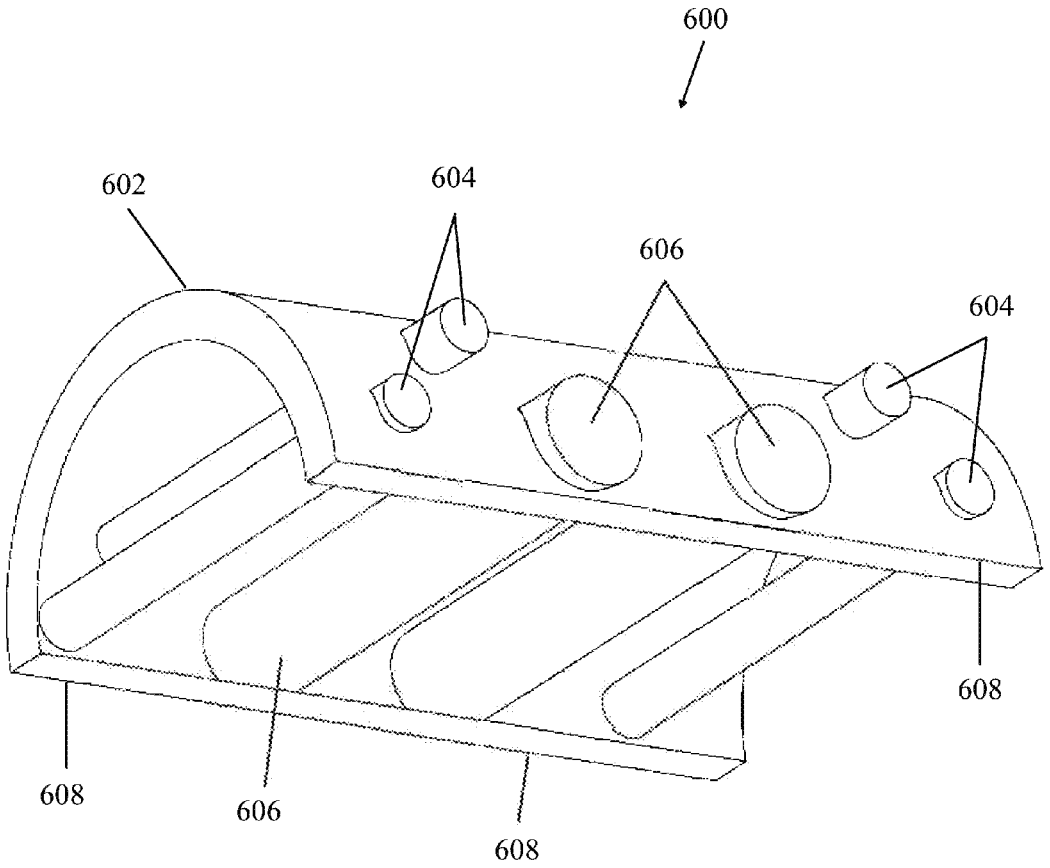
FIG. 7 shows a bottom perspective view of the vortex reduction cap of FIG. 6, in accordance with an aspect of the present invention.

FIGS. 6-7 show another preferred embodiment of a vortex reduction cap 600. Unlike the cap 100 of FIGS. 3-5, this preferred embodiment is formed as a half-cylinder, with the longitudinal axis of the cylinder oriented parallel to the horizontal plane of the discharge port. This cap 600 can be easily formed from, for example, a polymeric pipe, such as PVC pipe, by slicing a small section of pipe along its long axis to cut the pipe in half. In the embodiment of FIGS. 6-7, the PVC pipe may have, for example, a diameter of 4" and is approximately 4.5" long. Skilled persons will recognize that the cap size will depend on the size of the tank and of the discharge port.

Figure 8:
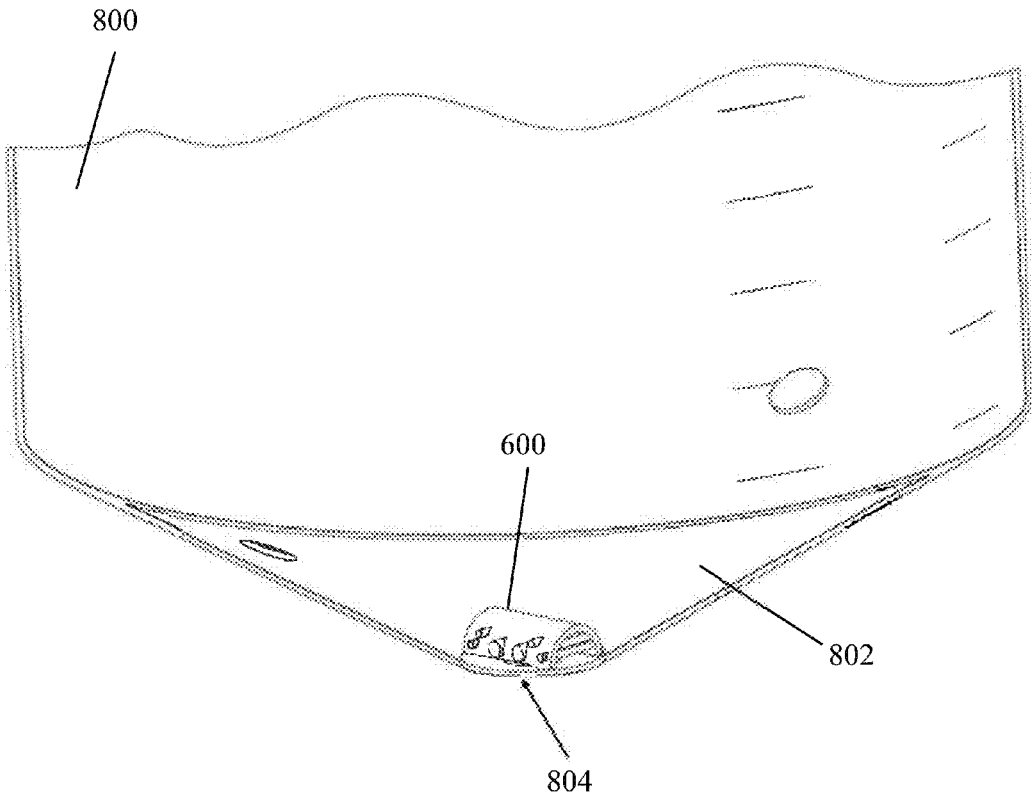
FIG. 8 shows the vortex reduction cap of FIG. 6 installed in a mixing tank over the discharge outlet, in accordance with an aspect of the present invention.
Figure 9:
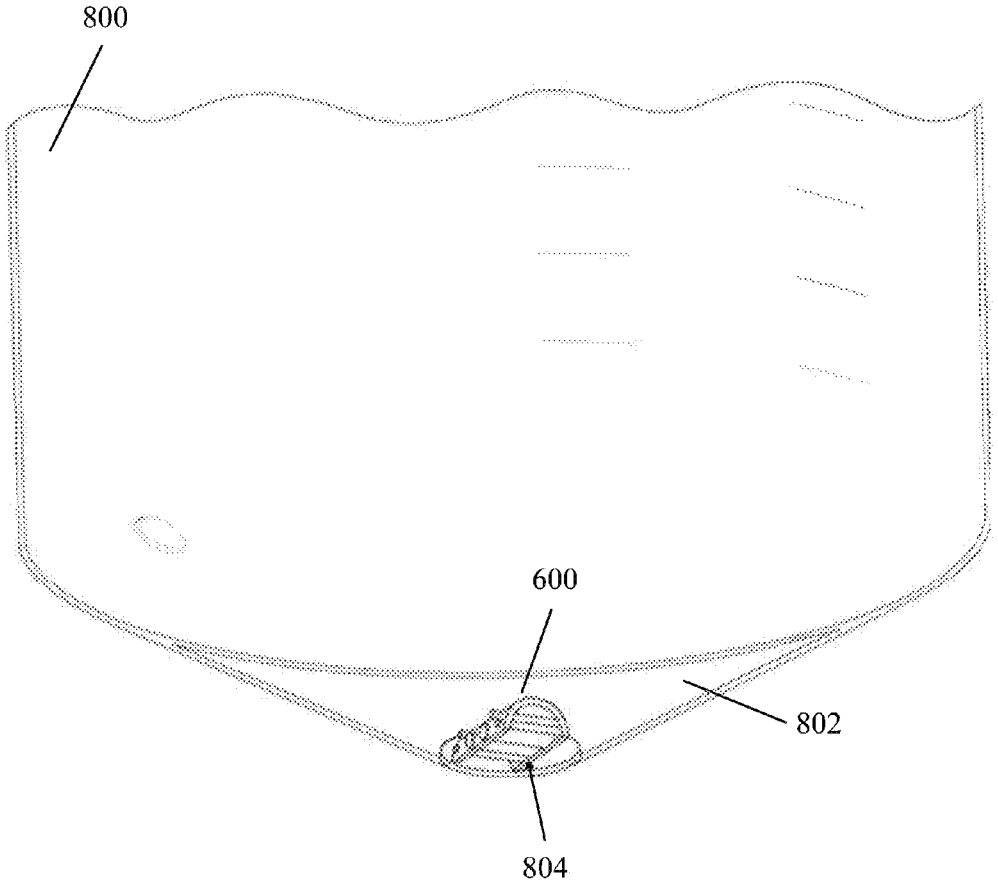
FIG. 9 shows a bottom perspective view of the vortex reduction cap of FIG. 10 installed in a mixing tank over the discharge outlet, in accordance with an aspect of the present invention.

FIGS. 8-9 show this half-cylinder vortex reduction cap 600 installed in a mixing tank 800 at the bottom of conical bottom 802 and over the discharge outlet 804. The half-cylinder cap 600 can be installed by tack welding the base (lower edge) 608 to the bottom surface of the tank 800 so that the cap 600 covers the discharge port. Because the ends of the half-cylinder cap 600 are both open, fluid will flow in both ends in a direction that will be largely perpendicular to the direction of flow that would occur without the cap 600. Obviously, this preferred embodiment has a much larger flow path than the embodiment described above as a result of fluid flow into both open ends of the cap 600, rather than through smaller orifices. This can be very advantageous in some applications by allowing higher flow rates without restricting pump suction.

As shown in FIGS. 6-7, one or more passive elements can be positioned inside the inner volume of the cap 600 to further redirect and break up the fluid flow. Static (no moving parts) cylindrical rods 604 and 606 can be inserted through the cap body so that fluid will have to flow around these rods 604, 606 to reach the discharge port. Although the rods 604, 606 shown are cylindrical, rods with any desired cross-section shape could be used. Further, while the rods of FIGS. 6-7 are oriented parallel to the open base of the cap 600, they could be oriented at any desired angle as long as they will serve as obstructions to the fluid flow through the cap 600, which serves to break up any smooth fluid flow and discourage the formation of any stable vortices.

For some tanks 800, the shape of the bottom of the tank 800 may make it difficult to position the cap 600 so that the edges are in full contact with the tank bottom inner surface, for example, if the tank 800 has a steep conical bottom. In that case, small rods, similar to the passive element rods 604, 606 described above, could be secured to the cap 600 to form "feet" which can be, for example, tack welded to the tank inner surface. Those vertically oriented rods or feet can also serve as passive elements to break up the fluid flow path.

Figure 10:
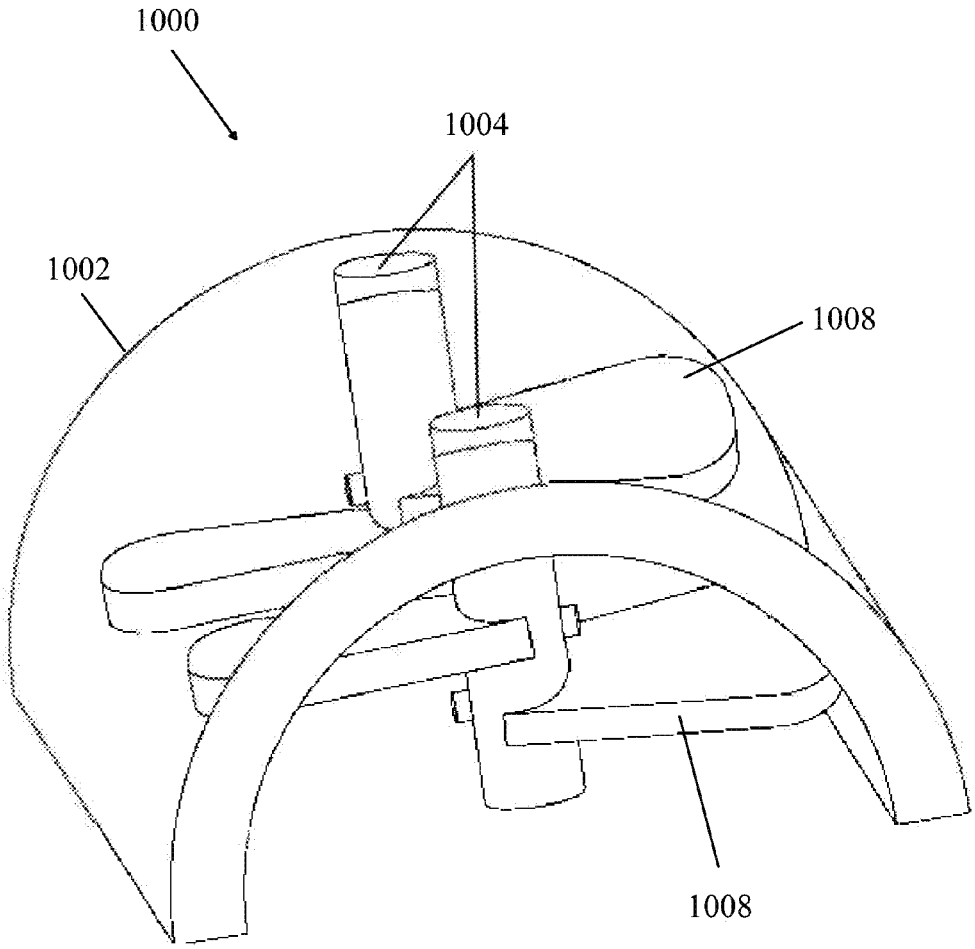
FIG. 10 shows an end perspective view of a vortex reduction cap, in accordance with an aspect of the present invention.
Figure 11:
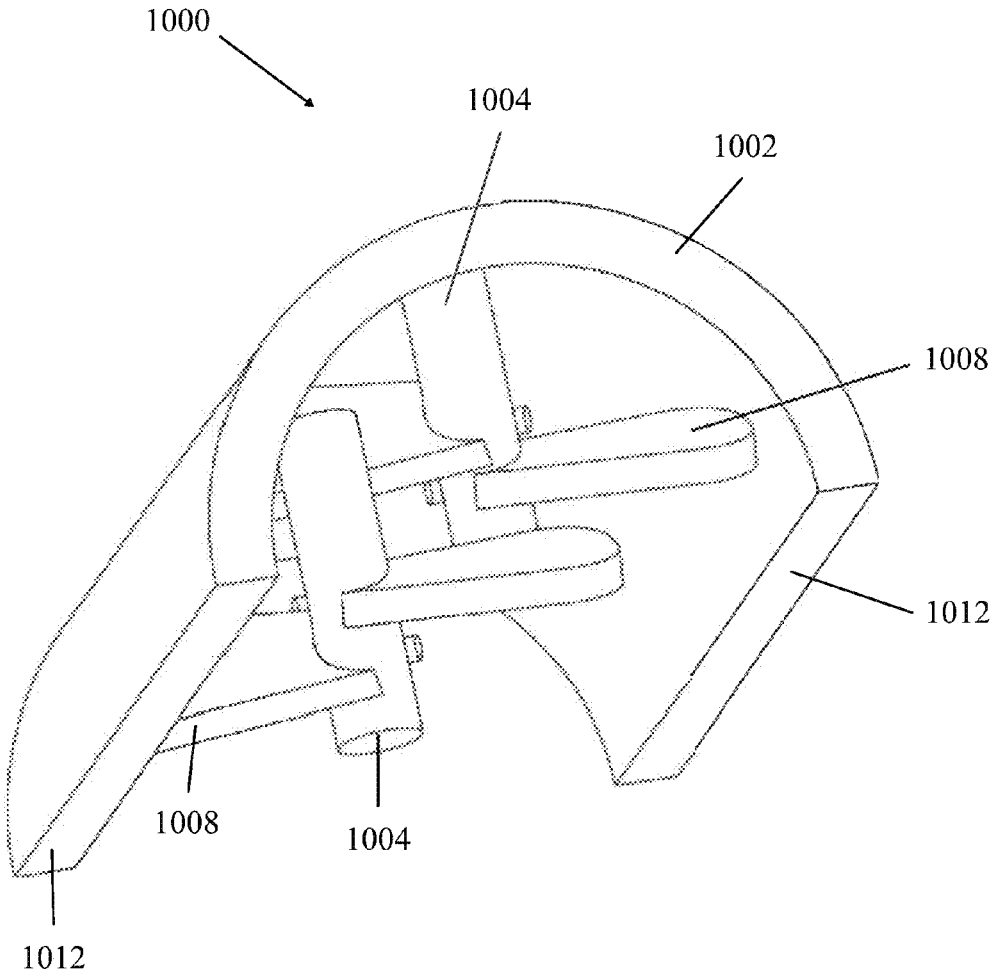
FIG. 11 shows a bottom perspective view of a vortex reduction cap, in accordance with an aspect of the present invention.
Figure 12:
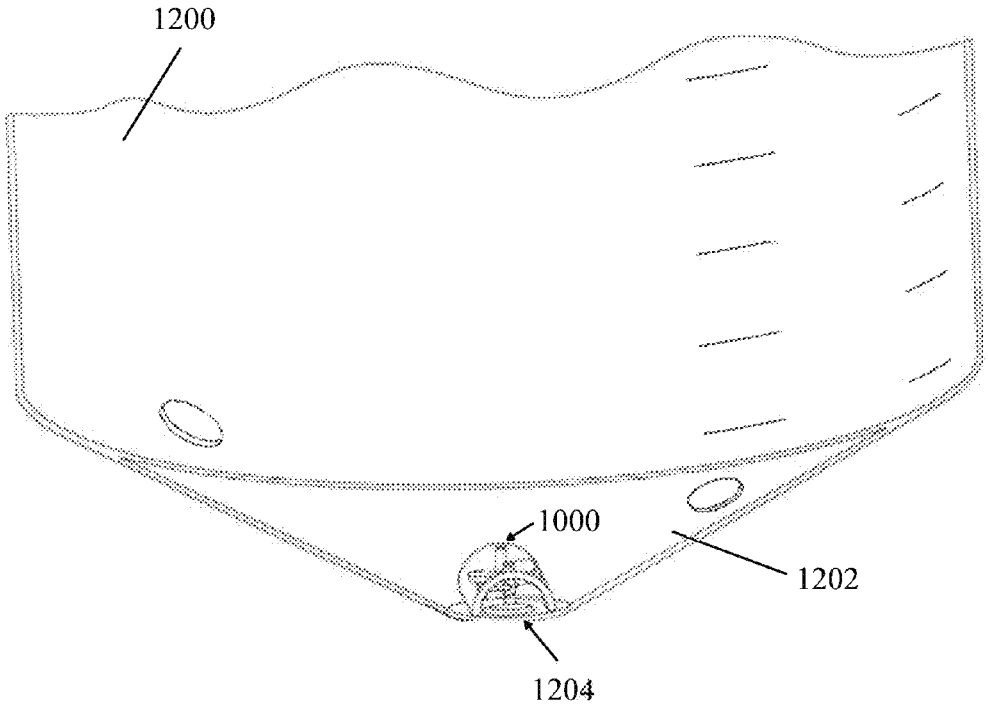
FIG. 12 shows a side perspective view of the vortex reduction cap of FIG. 10 installed in a mixing tank over the discharge outlet, in accordance with an aspect of the present invention.
Figure 13:
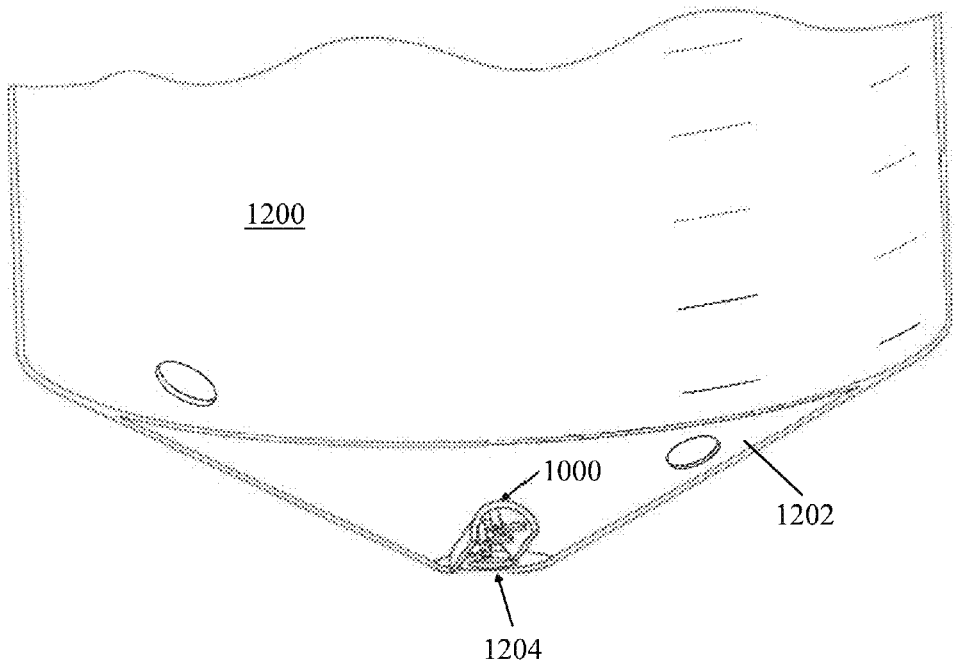
FIG. 13 shows an end perspective view of the vortex reduction cap of FIG. 10 installed in a mixing tank over the discharge outlet, in accordance with an aspect of the present invention.

FIGS. 10-11 show another preferred embodiment of a vortex reduction cap 1000. This cap 1000 is also formed as a half-cylinder like the embodiment of FIGS. 6-9 and can be made in the same fashion and from the same materials. Instead of the passive elements comprising static cylinders positioned in the interior volume as in the embodiment of FIGS. 6-9, the cap 1000 of FIGS. 10-11 makes use of one or more turbine blades 1008, each preferably rotating on a separate pin or shaft 1004. In this preferred embodiment, rather than having fluid flow in a direction that is orthogonal to the plane of the turbine blades as in the embodiment described above, the fluid flow is parallel to the plane of the turbine blades 1008 so that the flow is from the sides of the turbine blades. As in the embodiment described above, the rotational speed and direction of the turbine blades 1008 can be controlled by selecting an appropriate blade pitch for each of the blades 1008. In this embodiment both the blades 1008 and the shafts 1004 can function as passive elements to redirect or break up the flow path through the cap 1000, thus reducing or preventing the formation of vortices.

Although the description of the present invention above is mainly directed at an apparatus, it should be recognized that methods of using such an apparatus would further be within the scope of the present invention. Embodiments of the present invention have particular applicability for mixing and delivery of colloidal suspensions, including slurries used in CMP of semiconductor wafers. Such colloidal suspensions are notorious for separating from homogeneous distribution into constituent chemical components. More generally, however, the invention may be used in numerous other applications requiring homogeneous fluids, and it is not contemplated that the invention would be limited to slurry or CMP applications. Embodiments of the present invention may also be used for materials that have not been blended in the mixing/holding tank, but may have a propensity to stratify.

The invention has broad applicability and can provide many benefits as described and shown in the examples above. The embodiments will vary greatly depending upon the specific application, and not every embodiment will provide all of the benefits and meet all of the objectives that are achievable by the invention. Process fluid mixing and distribution systems suitable for carrying out the present invention are commercially available, for example, from Mega Fluid Systems, the assignee of the present application.

Although much of the previous description is directed at slurries used to manufacture semiconductor wafers, the invention could be applied to any fluid or application where the formation of surface vortices would be undesirable. In the discussion and in the claims, the terms "including" and "comprising" are used in an open-ended fashion, and thus should be interpreted to mean "including, but not limited to . . . ." To the extent that any term is not specially defined in this specification, the intent is that the term is to be given its plain and ordinary meaning. The accompanying drawings are intended to aid in understanding the present invention and, unless otherwise indicated, are not drawn to scale.

Although the present invention and its advantages have been described in detail, it should be understood that various changes, substitutions, and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A vortex reduction cap configured to be positioned within a fluid holding vessel above a discharge port for discharging fluid from the vessel, the vortex reduction cap comprising:

a top solid surface greater than or equal to the area of the discharge port in the vessel;

one or more inlets to allow fluid to flow from the vessel to an internal volume of the vortex reduction cap and then to the discharge port in the vessel; and at least one passive element positioned within the internal volume of the vortex reduction cap wherein the flow of fluid through the cap and toward the discharge port of the vessel will be redirected around the at least one passive element, the at least one passive element comprising:

at least one first turbine blade with a plurality of individual first blades; and at least one second turbine blade with a plurality of individual second blades;

wherein the turbine blades spin as the fluid flows past the blades and the plurality of individual first and second blades, each have a pitch angle, arranged around a central axis, and further comprising at least one shaft mounted to the top solid surface and extending toward the discharge port, said blades mounted so that fluid flow through the vortex reduction cap to the discharge port will cause the blades to rotate around the at least one shaft; and wherein the pitch angle of the plurality of individual first and second blades will cause each of the at least one first turbine blade to rotate around the shaft in a direction opposite the adjacent at least one second turbine blade.

2. The vortex reduction cap of claim 1 in which the passive element allows fluid to flow through the discharge port without a significant reduction in fluid volume throughput.

3. The vortex reduction cap of claim 1 in which the passive element allows fluid to flow through the discharge port without a reduction in fluid volume throughput of more than 5% as compared to fluid flow without the vortex reduction cap in place.

4. The vortex reduction cap of claim 1, further comprising:

a base connected to an interior surface of the vessel;

a side wall positioned between the top surface and the base; and in which a plurality of inlets are positioned in the side wall so that fluid can flow in through the inlets to the interior volume of the vortex reduction cap and out to the discharge port through the base of the cap.

5. The vortex reduction cap of claim 4 in which the vortex reduction cap is a hollow cylinder, closed at the top, but with an opening through the base fluidly connected to the discharge port of the vessel.

6. The vortex reduction cap of claim 4 in which the vertical plane of the inlets is perpendicular to a horizontal plane of the discharge port.

7. The vortex reduction cap of claim 4 in which the plurality of inlets are arranged in two rows but are staggered so that no inlet is aligned with an inlet in the other row.

8. The vortex reduction cap of claim 7 in which the inlets are positioned to provide balanced flow about the perimeter of the whirlpool reduction cap.

9. The vortex reduction cap of claim 4 further comprising a chute extending from the base into the discharge port.

10. The vortex reduction of claim 1 in which the fluid flow from the inlet to the discharge port is orthogonal to the individual blades.

11. The vortex reduction of claim 1, wherein the at least one first and second turbine blades are mounted on the same shaft.

12. The vortex reduction of claim 1, wherein the at least one first turbine blade and the at least one second turbine blade are mounted on a plurality of shafts.

* * * * *